United States Patent [19]

Sugimori et al.

[11] Patent Number: 4,831,069

[45] Date of Patent: May 16, 1989

[54] ACRYLONITRILE SPINNING SOLUTION AND PROCESS FOR PRODUCING FIBERS THEREWITH

[75] Inventors: Teruhiko Sugimori; Yoshifumi Furutani; Yoshinobu Shiraishi; Toshiyuki Yasunaga, all of Hiroshima, Japan

[73] Assignee: Mitsubishi Rayon Co., Ltd., Tokyo, Japan

[21] Appl. No.: 121,241

[22] Filed: Nov. 16, 1987

Related U.S. Application Data

[63] Continuation-in-part of Ser. No. 862,932, May 14, 1986, abandoned.

[30] Foreign Application Priority Data

May 14, 1985 [JP] Japan ..... 60-100536
May 21, 1985 [JP] Japan ..... 60-107021

[51] Int. Cl.[4] ..... C08K 5/20; C08L 9/02; C08L 55/00

[52] U.S. Cl. ..... 524/232; 524/566

[58] Field of Search ..... 524/566, 232

[56] References Cited

U.S. PATENT DOCUMENTS 2,879,242 3/1959 Weinstock, Jr. ..... 524/566

FOREIGN PATENT DOCUMENTS 60-021905 2/1985 Japan .

*Primary Examiner*—Joseph L. Schofer
*Assistant Examiner*—N. Sarofin
*Attorney, Agent, or Firm*—Sughrue, Mion, Zinn, Macpeak & Seas

[57] ABSTRACT

A spinning solution for acrylonitrile polymers is disclosed, which has a viscosity of 30 to 520 poises (at 50° C.) and which comprises an acrylonitrile polymer having a reduced viscosity of not less than 4.0, a solvent, and water, wherein the water concentration and the polymer concentration fall within the range in the drawing surrounded by straight lines connecting point A (1 wt % and 30 wt % respectively), point B (1 wt % and 10 wt % respectively), and point C (10 wt % and 10 wt % respectively). The spinning solution exhibits satisfactory spinnability in spite of its high polymer concentration and provides void-free acrylonitrile fibers having a highly circular cross-section and excellent mechanical strength.

11 Claims, 1 Drawing Sheet

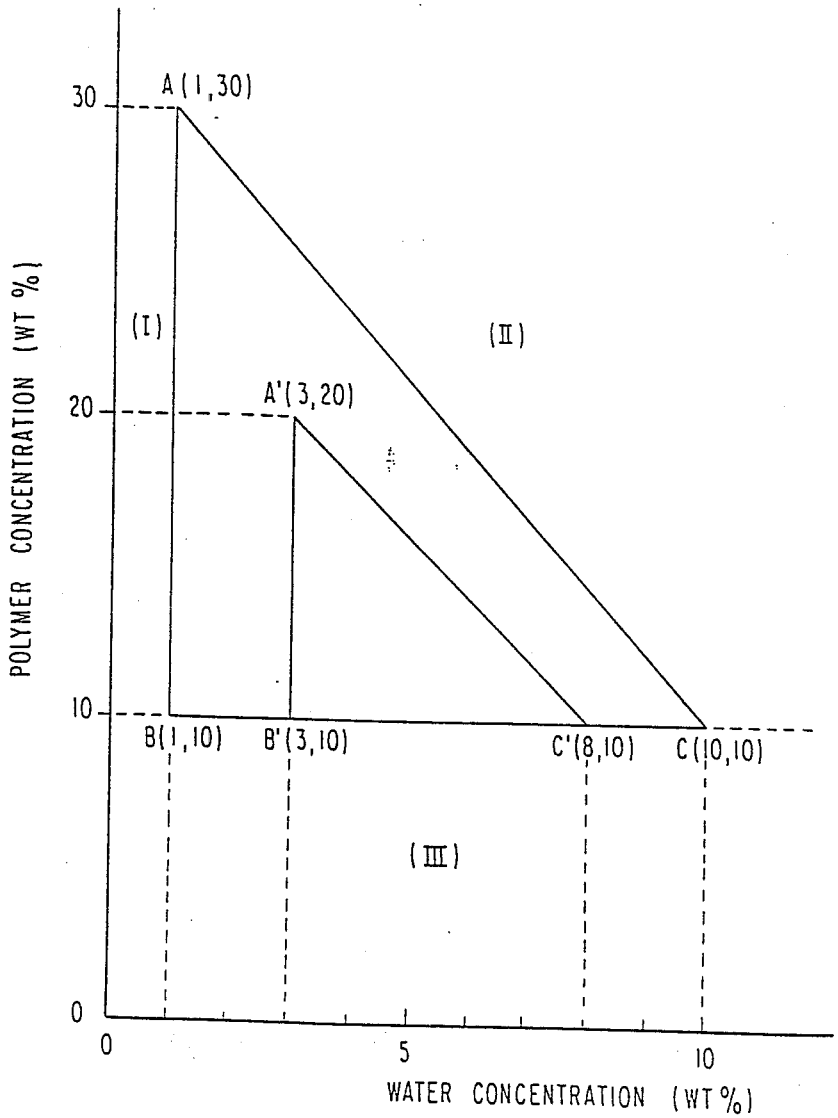
A(1,30)
A'(3,20)
B(1,10)
B'(3,10)
C'(8,10)
C(10,10)
(I)
(II)
(III)
30
20
10
0
0
5
10
POLYMER CONCENTRATION (WT %)
WATER CONCENTRATION (WT %)

ACRYLONITRILE SPINNING SOLUTION AND PROCESS FOR PRODUCING FIBERS THEREWITH

CROSS REFERENCE TO RELATED APPLICATION

This is continuation-in-part application of Ser. No. 862,932 filed May 14, 1986.

FIELD OF THE INVENTION

This invention relates to a spinning solution of an acrylonitrile polymer, a process for preparing the same and a process for producing high-strength and high-elasticity acrylonitrile fibers using the same.

BACKGROUND OF THE INVENTION

Acrylonitrile fibers have hitherto been used broadly in the field of clothing because of their characteristics, such as excellent light resistance, dyeing properties, and the like, but have scarcely been utilized for industrial use due to inferior mechanical strength as compared with nylon and polyester fibers. Development of high-strength acrylonitrile fibers has, therefore, been keenly desired.

In general, strength of acrylonitrile fibers decisively depends on properties of the polymer used. For example, Japanese Patent Application (OPI) No. 21905/85 (the term "OPI" as used herein means an "unexamined published patent application") discloses that an acrylonitrile polymer having a high average molecular weight, i.e., a reduced viscosity of 2.6 or higher, produces fibers having increased strength. However, the spinning solution according to this disclosure has an extremely high viscosity as shown in the following table indicating the relationship between the polymer concentration and the viscosity of the spinning solution at 45° C. In particular, when the polymer having high molecular-weight is used in the spinning solution in order to improve the fiber property, the viscosity of spinning solution becomes extremely high, and such a spinning solution is inferior in extrudability from a spinning nozzle, coagulation characteristics, and stretching characteristics of coagulated filaments.

| Polymer Concentration (wt %) | 6 | 8 | 10 | 12 |
|---|---|---|---|---|
| Viscosity of Spinning Solution (poise) | 1300 | 2100 | 5200 | 9000 |

The acrylonitrile polymer in such a high viscous spinning solution having a viscosity exceeding 1300 poises, and particularly exceeding 2000 poises, as measured at 45° C., are considerably restricted in their use. In other words, electron microscopic observation of coagulated filaments obtained by extruding a high viscous spinning solution into the coagulating bath reveals that the acrylonitrile polymer is not oriented in the direction of a fiber axis, but rather shows three-dimensional irregularity. It is very difficult to re-orient the acrylonitrile polymer of the coagulated fiber by subsequent wet heat stretching or dry heat stretching. As a method to reduce the viscosity of spinning solution, the method in which the polymer concentration in the spinning solution is decreased is generally used. However, when the spinning solution having low polymer concentration is spun, dissolution is caused in a large amount, and therefore the fiber structure is liable to be porous and to form devitrification, and fusion of coagulated filaments is liable to occur. Thus, methods to obtain a spinning solution sufficient in the fiber-forming properties by using high molecular-weight polymer without increasing the viscosity of spinning solution are still desired.

SUMMARY OF THE INVENTION

An object of this invention is to provide a spinning solution, comprising an acrylonitrile polymer at a high concentration, and having a reduced viscosity such that the acrylonitrile polymer can be sufficiently oriented in the direction of the fiber axis upon spinning.

Another object of this invention is to provide a process for producing acrylonitrile fibers having high-strength and a high modulus of elasticity by using such a spinning solution.

The objects of this invention can be achieved by spinning solution which has a viscosity of 30 to 520 poises (at 50° C.) and which comprises an acrylonitrile polymer having a reduced viscosity of not less than 4.0, a solvent, and water, wherein the water concentration and the polymer concentration fall within the range in the drawing surrounded by straight lines connecting point A (1 wt % and 30 wt % respectively), point B (1 wt % and 10 wt % respectively) and point C (10 wt % and 10 wt % respectively) (i.e., in rectangular coordinates with the former as abscissa and the latter as ordinate), and a process for producing acrylonitrile fibers, which comprises spinning such a spinning solution into a coagulating bath containing a solvent in concentrations of from 30 to 80 wt % by weight.

BRIEF DESCRIPTION OF THE ACCOMPANYING DRAWING

The accompanying drawing is a rectangular coordinate system indicating concentrations of water and a polymer of the spinning solution of the invention, with the former as abscissa and the latter as ordinate.

DETAILED DESCRIPTION OF THE INVENTION

The acrylonitrile polymer which can be used in the present invention has a reduced viscosity of not less than 4.0. The terminology "reduced viscosity" as herein used referres to the viscosity value as measured for 0.5 g of a polymer dissolved in 100 g of dimethylformamide at 25° C.

The acrylonitrile polymer to be used in the invention can be prepared, for example, by a process comprising initiating polymerization of a polytmerization system comprising from 10 to 70% by weight of a polymerizable unsaturated monomer comprising mainly of acrylonitrile, from 15 to 60% by weight of an organic solvent and from 15 to 60% by weight of water, with an organic solvent/water ratio being from 80/20 to 20/80, and preferably from 70/30 to 30/70, by weight, with a radical initiator, adding water and/or an organic solvent to the polymerization system in a total amount of from 1 to 10 parts by weight, and preferably from 3 to 8 parts by weight, per part by weight of the polymerizable monomer(s) charged before gelation of the polymerization system takes place, to thereby complete the polymerization. The acrylonitrile content of the acrylonitrile polymer to be used in the invention is preferably 80 wt % or more, more preferably 95 wt % or more, and most preferably 98 wt % or more. In particular, when the resulting acrylic fiber is carbonized to produce carbon fibers based on polyacrylonitrile, the acrylonitrile content must be 98 wt % or more.

Unsaturated monomers copolymerizable with acrylonitrile include unsaturated carboxylic acids, e.g., acrylic acid, methacrylic acid, itaconic acid, etc., and salts thereof; acrylic esters, e.g., methyl acrylate, ethyl acrylate, butyl acrylate, octyl acrylate, methoxyethyl acrylate, phenyl acrylate, cyclohexyl acrylate, etc.; methacrylic ester, e.g., methyl methacrylate, ethyl methacrylate, butyl methacrylate, octyl methacrylate, methoxyethyl methacrylate, phenyl methacrylate, cyclohexyl methacrylate, etc.; alkyl vinyl ketones; vinyl esters, e.g., vinyl acetate, vinyl propionate, vinyl butyrate, vinyl benzoate, etc.; vinylsulfonic acids, e.g., vinylsulfonic acid, methallylsulfonic acid, p-styrenesulfonic acid, etc., and salts thereof; halogenated vinyls or vinylidenes, e.g., vinyl chloride, vinylidene chloride, vinyl bromide, etc.; basic vinyl compounds, e.g., vinylpyridine, vinylimidazole, dimethylaminoethyl methacrylate, etc.; and other unsaturated monomers, e.g., acrylolein, methacrylonitrile, α-chloroacrylonitrile, etc. These comonomers may be used either alone or in combinations of two or more thereof.

Polymerization initiators which can be used in the present invention include general radical initiators, such as azo compounds, e.g., 2,2'-azobisisobutyronitrile, 2,2'-azobis(2,4-dimethylvaleronitrile), etc.; organic peroxides, e.g., aliphatic diacyl peroxides, peroxy esters, etc.; and the like. From the standpoint of polymerization stability and molecular weights of the resulting polymers, the polymerization initiator is used in an amount of from 0.0005 to 0.05 part by weight, and preferably from 0.001 to 0.002 part by weight, per part by weight of the charged polymerizable unsaturated monomer(s).

The pinning solution in accordance with the present invention is prepared using the above-described acrylonitrile polymer, a solvent, and water. In the preparation, concentrations of water and the acrylonitrile polymer in the spinning solution should be within the range in the drawing surrounded by straight lines connecting point A (1 wt %, 30 wt %), point B (1 wt %, 10 wt %) and point C (10 wt %, 10 wt %), preferably connecting point A' (3 wt %, 20 wt %), point B' (3 wt %, 10 wt %) and point C' (8 wt %, 10 wt %). In the drawing, even when spinning solutions having compositions in the region (I) are spun into a coagulating bath having an adequate composition under adequate coagulation conditions, the resulting coagulated filamnnts have a noncircular, horsebean, or the like cross-section, and nonuniform fineness. Further, many voids are formed therein to cause frequent occurrences of breaking during the subsequent washing and stretching steps, thus resulting in failure to produce usable fibers. Spinning solutions having compositions in the region (II) are incapable of spinning due to gelation. Further, spinning solutions having compositions of the region (III) have poor fiber-forming properties due to low polymer concentrations so that many voids are formed in the coagulated fibers.

The solvents which can be used in the preparation of spinning solutions include organic solvents such as dimethylformamide, dimethylacetamide, dimethyl sulfoxide, γ-butyrolactone, etc.; aqueous solutions of thiocyanates, an aqueous solution of zinc chloride, nitric acid, and the like, with the organic solvents, and partiuularly dimethylformamide and dimethylacetamide, being preferred.

Since the acrylonitrile polymers according to the present invention have a lower water content than that of those obtained by general aqueous suspension polymerization, they are highly soluble in organic solvents without being subjected to forced heating or drying, from which a spinning solution having a water content of not more than 10% by weight can be prepared. Hence, polymerization and spinning can be carried out continuously, omitting a drying step.

The spinning solution of the invention can be prepared by a process which comprises initiating polymerization of a mixture comprising from 10 to 70% by weight of a polymerizable unsaturated monomer comprising mainly of acrylonitrile, from 15 to 60% by weight of an organic solvent and from 15 to 60% by weight of water, with an organic solvent/water ratio being from 80/20 to 20/80, and preferably from 70/30 to 30/70, by weight, with a radical initiator, adding water and/or an organic solvent to the polymerization system in a total amount of from 1 to 10 parts by weight, and preferably from 3 to 8 parts by weight, per part of the charged polymerizable unsaturated monomer(s) after the stage when a polymer begins to precipitate, to complete the polymerization, separating the resulting acrylonitrile polymer from the polymerization system, replacing the solvent with an organic solvent if desired, adjusting the total content of water and the organic solvent to 150% by weight or less, and dissolving the resulting polymer in a solvent for polyacrylonitrile to form an acrylonitrile polymer spinning solution having a polymer concentration of from 10 to 30% by weight and a water content of from 1 to 10% by weight.

The polymerizable unsaturated monomers copolymerizable with acrylonitrile, the organic solvents and the radical initiators which can be used here and their amounts to be used are as described above. In more detail with reference to the amount of the organic solvent, if it is less than 15% by weight based on the mixture, the water content in the polymer separated from the polymerization system becomes too high, making it impossible to obtain a spinning solution containing 10% by weight or less of water. On the other hand, if it exceeds 65% by weight, the organic solvent acts as a chain transfer agent to reduce the molecular weight of the resulting polymer, which tends to lead to impairment of performance properties of the fibers obtained by spinning, and, in particular, leads to reduction in strength and modulus of elasticity.

The polymerization may be carried out in either a batch system using a single vessel, in which a mixture of a given composition is charged in a flask and a polymerization medium is supplemented after precipitation of a polymer, or a continuous system using two or more reaction vessels, in which a mixture of a given composition is continuously fed to a first vessel to initiate tee polymerization and adding a polymerization medium to a second or any other vessel. The thus obtained polymer is separated from the polymerization system and then dissolved in a solvent to obtain an acrylonitrile polymer solution having a polymer content of from 10 to 30% by weight and a water content of from 1 to 10% by weight.

In the above-described polymerization process, since the polymerization medium in the polymerization system is a mixed solvent composed of an organic solvent and water, the resulting polymer exhibits good solubility in organic solvents despite of the relatively high solvent content as 150% by weight or less, and preferably 100% by weight or less, after filtration and compression dehydration. Therefore, a polymer solution having any desired polymer concentration and water content can be easily obtained.

The spinning solution according to the present invention contains an acrylonitrile polymer having a reduced viscosity as high as 4.0 or greater, at a polymer concentration as high as 10% by weight or more. Nevertheless, the presence of water in a proportion of from 1 to 10% by weight makes it possible to maintain a viscosity of 30 to 520 poises, at 50° C. with markedly high stability. Further, upon spinning of the spinning solution through a spinning nozzle into a coagulating bath, the acrylonitrile polymer can be oriented in the direction of a fiber axis with an extremely high efficiency. Such an orientation improving effect can never be achieved with a spinning solution that does not contain a specific amount of water. In addition, solvent removal from coagulated fibers can be performed smoothly by the effect of water present in the spinning solution, to thereby obtain coagulated fibers substantially free from voids. Accordingly, the subsequent stretching and drying steps can be conducted without involving unfavorable phenomena, such as breaking of fibers, to produce acrylonitrile fibers possessing extremely excellent characteristics.

The spinning solution prepared by the above-described process can be applied to general wet spinning or dryjet wet spinning, in either of which it is typically spun into a coagulating bath having a solvent concentration of from 30 to 80% by weight, followed by post-treatment to obtain desired fibers. In the present invention, dryjet wet spinning is preferably employed. The solvents for the coagulating bath preferably include the above-enumerated organic solvents.

If the spinning solution of the invention is spun into a coagulating bath containing the solvent in concentrations less than 30% by weight, solvent replacement between the solvent in the thus formed filaments and water in the coagulating bath abruptly takes place. When coagulated filaments obtained from such a coagulation system are washed and stretched, the resulting acrylonitrile fibers lose clarity due to the presence of many voids and are liable to fibrillation, thus seriously reducing usefulness. On the other hand, if the coagulating bath contains 80% by weight or more of the solvent, the rate of solvent removal from the formed filaments is conspicuously deteriorated to induce frequent occurrences of fiber breaks during the subsequent washing and stretching steps.

According to the present invention wherein a spinning solution having specific water content and polymer concentration is spun into a coagulating bath having a solvent content of from 30 to 80% by weight, penetration of excess water into coagulated filaments can be prevented by the action of the water contained in the spinning solution, and the solvent can be efficiently removed from the filaments so that void-free filaments can be formed without attending deformation of the cross-sectional shape of the filaments. Furthermore, if the coagulated filaments thus obtained are stretched, washed, and dried, high-strength acrylic fibers having strength of 5.5 g/d or more, or of 10 g/d or more when a dryjet wet spinning method is employed, can be obtained. Generally, the acrylonitrile polymer in which the copolymerizable component to acrylonitrile is little is unsuitable for preparing a spinning solution due to the low solubility to the solvent, and even if the spinning solution can be prepared, it is impossible to be spun by conventional technique because voids are liable to occur in coagulation process due to the fast coagulation rate. To the contrary, the present invention realizes to spin the low copolymerizable component-containing acrylic polymer by using the high molecular-weight polymer according to the present invention and the water-containing spinning solution of the present invention.

As a result, the present invention realizes spinning with satisfactory spinnability using a spinning solution containing a highly polymerized acrylonitrile polymer in high concentrations, which is very significant in the fiber industry. To make a contrast with the conventional acrylonitrile fibers obtained by wet spinning, the fibers obtained by the present invention contain remarkably reduced voids, have a truly circular cross-section and exhibit excellent mechanical strength. Therefore, these fibers are useful as reinforcing materials for composite materials or carbon fiber precursors.

This invention will now be illustrated in greater detail with reference to the following examples, but it should be understood that they are not intended to limit the present invention.

EXAMPLE 1

A composition shown in Table 1 below was charged in a 2 liter-volume four-necked flask equipped with a stirrer, a thermometer, a reflux condenser and a tube for introducing nitrogen. After displacing the atmosphere in the flask with nitrogen, the composition was heated to initiate polymerization. At the time when the polymerization system became turbid, an additional amount of the solvent shown in Table 1 was added thereto, followed by continuing the heating for about 4 hours to complete the polymerization. The resulting polymer was washed and dried to obtain a polymer (A), (B) or (C). The reduced viscosity of these polymers are shown in Table 1.

TABLE 1

| Sample No. | Polymerizable Composition: Acrylonitrile (g) | Methacrylic Acid (g) | DMF*1 (g) | Water (g) | AIBN*2 (g) | Polymerization Temperature (°C.) | Additional Solvent (Amount) (g) | Conversion (%) | Reduced Viscosity (ηred) | Remarks |
|---|---|---|---|---|---|---|---|---|---|---|
| A | 294 (24.5)*3 | 6 (0.5) | 450 (37.5) | 450 (37.5) | 4 | 55 | DMF (450) | 72 | 2.01 | Comparison |
| B | 294 (24.5) | 6 (0.5) | 450 (37.5) | 450 (37.5) | 3 | 55 | DMF (450) Distilled water (450) | 69 | 4.46 | Invention |
| C | 294 (24.5) | 6 (0.5) | 300 (25) | 600 (50) | 3 | 55 | Distilled water | 71 | 6.32 | Invention |

TABLE 1-continued

| Sample No. | Polymerizable Composition: Acrylonitrile (g) | Methacrylic Acid (g) | DMF*1 (g) | Water (g) | AIBN*2 (g) | Polymerization Temperature (°C.) | Additional Solvent (Amount) (g) | Conversion (%) | Reduced Viscosity (ηred) | Remarks |
|---|---|---|---|---|---|---|---|---|---|---|
| | | | | | | | (600) | | | |

Note:
*1Dimethylformamide
*2,2'-Azobisisobutyronitrile
*3Values in the parentheses are % by weight based on the composition excluding AIBN.

EXAMPLE 2

A spinning solution was prepared using Polymer (B) as prepared in Example 1 as an acrylonitrile polymer in a concentration of 14% by weight and, as solvents, dimethylformamide (DMF) and water in concentrations as shown in Table 2 below. The resulting spinning solution was spun through a spinning nozzle having 500 holes into a coagulating bath consisting of 78% by weight of DMF and 22% by weight of water, followed by washing, stretching and drying to obtain acrylonitrile fibers. The properties of the spinning solution and the coagulated filaments are shown in Table 2.

As is apparent from the results of Table 2, it can be seen that the spinning solution of the present invention has a good stability and that the coagulating filaments obtained are circular shape cross-section and have few formation of voids.

EXAMPLE 3

A spinning solution was prepared using Polymer (B) as prepared in Example 1 as an acrylonitrile polymer and water at concentrations shown in Table 3 below. Each of the resulting spinning solutions was wet-spun in a coagulating bath consisting of 78% by weight of dimethylformamide and 22% by weight of water, and the coagulated filaments were subjected to stretching at a stretch ratio shown in Table 3, followed by washing and drying to obtain acrylonitrile fibers. Properties of the resulting fibers are also shown in Table 3.

As is apparent from the results of Table 3, the spinning solution of the present invention comprising the polymer having high reduced viscosity can have low viscosity and the resulting fibers have excellent properties.

TABLE 2

| Run No. | Composition of Spinning Solution: Polymer (B) (wt %) | Water (wt %) | DMF (wt %) | Spinning Solution | Coagulated Filaments: Cross-Section | Formation of Voids | Remarks |
|---|---|---|---|---|---|---|---|
| 1 | 14 | 0 | 86 | Dissolved state with good stability | Horsebean shape, uneveness | Many voids formed | Comparison |
| 2 | 14 | 2 | 84 | Dissolved state with good stability | Substantially circular shape | Few voids formed | Present invention |
| 3 | 14 | 4 | 82 | Dissolved state with good stability | Substantially circular shape | Few voids formed | Present invention |
| 4 | 14 | 6 | 80 | Dissolved state with good stability | True circular shape | Void-free | Present invention |
| 5 | 14 | 12 | 74 | Gellation, unspinnable | — | — | Comparison |

TABLE 3

| Run No. | Composition of Spinning Solution: Polymer (B) (wt %) | Water (wt %) | DMF (wt %) | Viscosity of Spinning solution (50° C.) (poise) | Property of Spinning Solution | Property of fibers: Stretch Ratio | Strength (g/d) | Elongation (%) | Remarks |
|---|---|---|---|---|---|---|---|---|---|
| 1 | 10 | 2 | 88 | 65 | Dissolved state with good stability | 8 | 9.3 | 7.3 | Present invention |
| 2 | 10 | 8 | 82 | 50 | Dissolved state with good stability | 8 | 8.4 | 8.0 | Present invention |
| 3 | 22 | 2 | 76 | 520 | Dissolved state with good stability | 8 | 9.2 | 7.1 | Present invention |
| 4 | 6 | 2 | 92 | 30 | Dissolved state with good | 8 | 4.6 | 13.2 | Comparison |

TABLE 3-continued

| Run No. | Composition of Spinning Solution: Polymer (B) (wt %) | Water (wt %) | DMF (wt %) | Viscosity of Spinning solution (50° C.) (poise) | Property of Spinning Solution | Property of fibers: Stretch Ratio | Strength (g/d) | Elongation (%) | Remarks |
|---|---|---|---|---|---|---|---|---|---|
| | | | | | stability | | | | |
| 5 | 32 | 2 | 66 | 1860 | Gellation, unspinnable | — | — | — | Comparison |
| 6 | 10 | 12 | 78 | 90 | Gellation, unspinnable | — | — | — | Comparison |

EXAMPLE 4

Polymerization was carried out in the same manner as described in Example 1 except using the composition and additional solvent as shown in Table 4. After completion of the polymerization, the resulting slurry was subjected to centrifugal hydro-extraction and compression dehydration to obtain a wet powder of the polymer having a residual solvent content of 100% by weight. Dimethylformamide was added to the wet powder to form a spinning solution having the composition as shown in Table 4. Reduction of the water content to the desired level was effected by adding dimethylformamide to the wet polymer powder in such an amount that the polymer was not dissolved, dispersing the polymer, subjecting the dispersion to filtration followed by compression dehydration, again adding dimethylformamide thereto so as to result in a desired polymer concentration, and dissolving the mixture by heating to obtain a polymer solution.

COMPARATIVE EXAMPLE 1

Acrylonitrile was polymerized by precipitation polymerization in an aqueous system using a redox initiator system composed of potassium persulfate as an oxidizing agent and sodium hydrogen sulfite as a reducing agent and sulfuric acid as a pH-adjusting agent. After the resulting polymer slurry was dehydrated by compression, it was attempted to form a polymer solution in the same manner as described in Example 4, but the attempt failed due to difficulty in decreasing the water content to 10% by weight or less. Therefore, solvent displacement with dimethylformamide was carried out, and an additional amount of dimethylformamide was then added thereto to form a spinning solution.

The polymerization procedures of Example 4 and Comparative Example 1 and properties of the resulting polymers are summarized in Table 4. The procedures of spinning solution preparation of Example 4 and Comparative Example 1 and compositions of the resulting spinning solutions are summarized in Table 5.

TABLE 4

| Run No. | Polymerizable Composition: AN* (g) | Methacrylic Acid (g) | DMF** (g) | Water (g) | Initiator (g) | Polymerization Temperature (°C.) | Added Solvent (Amount) (g) | Conversion (%) | Reduced Viscosity ($\eta$red) | Remarks |
|---|---|---|---|---|---|---|---|---|---|---|
| 1 | 294 (24.5)**** | 6 (0.5) | 450 (37.5) | 450 (37.5) | AIBN*** 4 | 55 | DMF 450 | 72 | 2.01 | Comparison |
| 2 | 294 (24.5) | 6 (0.5) | 450 (37.5) | 450 (37.5) | AIBN 3 | 55 | DMF 450 Distilled water 450 | 69 | 4.46 | Example 4 |
| 3 | 200 | — | — | 1000 | $K_2S_2O_8$ 0.51 $NaHSO_3$ 2.43 | 50 | — | 60 | 1.90 | Comparative Example 1 |

Note:
*Acrylonitrile
**Dimethylformamide
***2,2'-Azobisisobutyronitrile
****Values in the parentheses are % by weight based on the composition excluding the initiator.

TABLE 5

| Run No. | Polymer/solvent Ratio after Compression Dehydration* (by wt) | Amount of DMF Added (wt %/polymer) | Polymer/Solvent Ratio after Compression Dehydration* (by wt) | Amount of DMF Added (wt %/polymer) | Spinning Solution: Polymer/DMF/Water Ratio (by wt) | Polymer Concentration (wt %) | Water Content (wt %) | Sample No. |
|---|---|---|---|---|---|---|---|---|
| 1 | 100/100 (70/30)** | 100 | 100/100 (84/16)** | 300 | 100/384/16 | 20 | 3.2 | 1 |
| 2 | 100/100 (50/50) | 500 | — | — | 100/550/50 | 14.3 | 7.1 | 2 |
| | 100/100 (50/50) | 100 | 100/100 (75/25) | 400 | 100/475/25 | 16.7 | 4.2 | 3 |
| 3 | 100/100 (0/100) | 300 | 100/100 (75/25) | 400 | 100/475/25 | 16.7 | 4.2 | 4 |
| | | 800 | — | — | 100/800/100 | 10 | 10 | — |

TABLE 5-continued

| Run No. | Polymer/solvent Ratio after Compression Dehydration* (by wt) | Amount of DMF Added (wt %/polymer) | Polymer/Solvent Ratio after Compression Dehydration* (by wt) | Amount of DMF Added (wt %/polymer) | Spinning Solution: Polymer/DMF/ Water Ratio (by wt) | Spinning Solution: Polymer Concentration (wt %) | Spinning Solution: Water Content (wt %) | Spinning Solution: Sample No. |
|---|---|---|---|---|---|---|---|---|
| | | | | | | (not dissolved) | | |

Note:
*Compression dehydration was conducted under a pressure of 15 Kg/cm$^2$ for 5 minutes.
**Weight ratios of DMF/water.

EXAMPLE 5

Each of the spinning solutions shown in Table 5 (Sample Nos. 1 to 4) was wet-spun into a coagulating bath consisting of 78% by weight of DMF and 22% by weight of water. The coagulated fibers were stretched at a stretch ratio shown in Table 6 below, washed and dried to obtain acrylonitrile fibers. The properties of the resulting fibers are shown in Table 6.

TABLE 6

| Sample No. | Spinning Solution: Polymer Concentration (wt %) | Spinning Solution: Water Content (wt %) | Spinning Solution: Viscosity (50° C.) (poise) | Stretch Ratio | Strength (g/d) | Elongation (%) |
|---|---|---|---|---|---|---|
| 1 (Comparison) | 20 | 3.2 | 85 | 8 | 5.4 | 12.8 |
| 2 (Invention) | 14.3 | 7.1 | 43 | 10 | 6.1 | 10.9 |
| 3 (Invention) | 16.7 | 4.2 | 200 | 6 | 5.5 | 13.6 |
| 4 (Comparison) | 16.7 | 4.2 | 100 | 8 | 3.2 | 12.4 |

As is apparent from the results of Table 6, the spinning solution of the present invention comprising the polymer having high reduced viscosity can have low viscosity and the resulting fibers have excellent properties.

EXAMPLE 6

A spinning solution was prepared using Polymer (C) as prepared in Example 1 as an acrylonitrile polymer in a concentration of 15% by weight and, as solvents, dimethylformamide (DMF) and water in concentrations as shown in Table 7 below. The resulting spinning solution was spun through a spinning nozzle having 500 holes (hole diameter: 0.15 mm) into a coagulating bath consisting of 78% by weight of DMF and 22% by weight of water by dryjet wet spinning method at 15° C., followed by washing, stretching and drying to obtain acrylonitrile fibers. The properties of the spinning solution and the coagulated filaments are shown in Table 7.

As is apparent from the results of Table 7, it can be seen that the spinning solution of the present invention has a good stability and that the coagulating filmments obtained are circular shape cross-section and have few formation of voids.

TABLE 7

| Run No. | Composition of Spinning Solution: Polymer (C) (wt %) | Composition of Spinning Solution: Water (wt %) | Composition of Spinning Solution: DMF (wt %) | Spinning Solution | Coagulated Filaments: Cross-Section | Coagulated Filaments: Formation of Voids | Remarks |
|---|---|---|---|---|---|---|---|
| 1 | 15 | 0 | 85 | Dissolved state with good stability | Horsebean shape, | Many voids formed | Comparison |
| 2 | 15 | 2 | 83 | Dissolved state with good stability | True circular shape | Few voids formed | Present invention |
| 3 | 15 | 4 | 81 | Dissolved state with good stability | True circular shape | Void-free | Present invention |
| 4 | 15 | 6 | 79 | Dissolved state with good stability | True circular shape | Void-free | Present invention |
| 5 | 15 | 8 | 77 | Gellation, unspinnable | Scaly wrikle is formed on the side | — | Comparison |

EXAMPLE 7

Each of spinning solutions was prepared using Polymer (A), (B), or (C) as prepared in example 1 as an acrylonitrile polymer in a concentration shown in Table 8 below and, as solvents, DMF and water in concentrations as shown in Table 8 below. Each of the resulting spinning solutions was spun through a spinning nozzle having 500 holes (hole diameter: 0.15 mm) into a coagulating bath consisting of 78% by weight of DMF and 22% by weight of water by dryjet wet spinning method at 0° C. The coagulated fibers were washed, and stretched and further dry-heat stretched. The properties of the resulting fibers are shown in Table 8.

As is apparent from the results of Table 8, it can be seen that the fibers obtained by the present invention have excellent properties.

TABLE 8

| Run No. | Polymer | ηred | Spinning Solution: AN Polymer/water/DMF (wt %) | Spinning Solution: Viscosity (50° C.) (poise) | Stretch Ratio | Properties: Strength (g/d) | Properties: Elongation (%) |
|---|---|---|---|---|---|---|---|
| 1 (Comparison) | (A) | 2.01 | 23/1/76 | 481 | 9 | 8.4 | 8.6 |
| 2 (Invention) | (B) | 4.46 | 18/3/79 | 502 | 9 | 10.8 | 8.1 |
| 3 (Invention) | (C) | 6.32 | 15/4/81 | 510 | 9 | 11.0 | 7.9 |

EXAMPLE 8

A spinning solution was prepared using Polymer (C) as prepared in Example 1 as an acrylonitrile polymer in a concentration of 14% by weight and, as solvents, dimethylacetamide (DMAc) and water in concentrations of 85% and 1% by weight, respectively. The solution had viscosity of 470 poises at 50° C. The resulting spinning solution was spun through a spinning nozzle having 500 holes (hole diameter: 0.15 mm) into a coagulating bath consisting of 77% by weight of DMAc and 23% by weight of water by dryjet wet spinning method at 0° C. The coagulated fiber was washed and stretched, and further dry-heat stretched to total stretch ratio of 9. The resulting fiber had strength of 10.5 g/d and elongation of 8.1%.

While the invention has been described in detail and with reference to specific embodiments thereof, it will be apparent to one skilled in the art that various changes and modifications can be made therein without departing from the spirit and scope thereof.

What is claimed is:

1. A spinning solution having a viscosity of 30 to 520 poises (at 50° C.) comprising an acrylonitrile polymer having a reduced viscosity of not less than 4.0, a solvent, and water, wherein the water concentration and the polymer concentration of the spinning solution fall within the range in the drawing surrounded by straight lines connecting point A (1 wt % and 30 wt % respectively), point B (1 wt % and 10 wt % respectively), and point C (10 wt % and 10 wt % respectively).

2. A spinning solution as in claim 1, wherein said acrylonitrile polymer is obtained by initiating polymerization with a radical initiator of a polymerization system comprising from 10 to 70% by weight of a polymerizable unsaturated monomer mixture containing at least 70 mol % of acrylonitrile, from 15 to 60% by weight of an organic solvent and from 15 to 60% by weight of water, the organic solvent/water weight ratio being from 80/20 to 20/80, adding at least one of said organic solvent and water to the polymerization system in a total amount of from 1 to 10 parts by weight per part by weight of the charged polymerizable monomer or monomers after the stage when a polymer begins to precipitate, to complete the polymerization system, separating the resulting acrylonitrile polymer from the polymerization system, adjusting the total content of water and said organic solvent to 150% by weight or less based on the weight of the polymer, and dissolving he resulting polymer in a solvent therefor.

3. A spinning solution as in claim 2, wherein said organic solvent/water weight ratio of the polymerization system is from 70/30 to 30/70.

4. A spinning solution as in claim 2, wherein at least one of said organic solvent and water is added to the polymerization system in a total amount of from 3 to 8 parts by weight per part by weight of the charged polymerizable monomer or monomers.

5. A spinning solution as in claim 2, wherein said radical initiator is an azo compound or an organic peroxide.

6. A spinning solution as in claim 2, wherein said adjusting of the total content of water and said organic solvent is carried out by solvent replacement.

7. A spinning solution as in claim 1, wherein said solvent is dimethylformamide or dimethylacetamide.

8. A spinning solution having a viscosity of 30 to 520 poises (at 50° C.) comprising an acrylonitrile polymer having a reduced viscosity of not less than 4.0, dimethylformamide or dimethylacetamide as a solvent, and water, wherein the water concentration and the polymer concentration of the spinning solution fall within the range in the drawing surrounded by straight lines connecting point A' (3 wt % and 20 wt %, respectively), point B' (3 wt % and 10 wt %, respectively), and point C' (8 wt % and 10 wt %, respettively).

9. A spinning solution as in claim 8, wherein said acrylonitrile polymer is obtained by initiating polymerization with a radical initiator of a polymerization system comprising from 10 to 70% by weight of a polymerizable unsaturated monomer comprising mainly of acrylonitrile, from 15 to 60% by weight of an organic solvent and from 15 to 60% by weight of water, with the organic solvent/water weight ratio being from 80/20 to 20/80, adding at least one of said organic solvent and water to the polymerization system in a total amount of from 1 to 10 parts by weight per part by weight of the charged polymerizable monomer or monomers after the stage when a polymer begins to precipitate, to complete the polymerization system, separating the resulting acrylonitrile polymer from the polymerization system, adjusting the total content of water and said organic solvent to 150% by weight or less based on weight of the polymer, and dissolving the resulting polymer in said solvent therefor.

10. A spinning solution as in claim 9, wherein said organic solvent/water weight ratio of the polymerization system is from 70/30 to 30/70.

11. A spinning solution as in claim 9, wherein said at least one of said organic solvent and water is added to the polymerization system in a total amount of from 3 to 8 parts by weight per part by weight of the charged polymerizable monomer or monomers.

* * * * *